United States Patent [19]

Kotani et al.

[11] 4,442,429

[45] Apr. 10, 1984

[54] DISPLAY APPARATUS UTILIZING A THERMALLY COLOR REVERSIBLE DISPLAY MEDIUM WHICH HAS A HYSTERESIS EFFECT

[75] Inventors: Shintaro Kotani; Ichimatsu Abiko; Takashi Arae; Mio Chiba; Tomoo Araki; Hiromasa Kanno, all of Tokyo, Japan

[73] Assignee: Oki Electric Industry Co., Ltd., Tokyo, Japan

[21] Appl. No.: 301,598

[22] Filed: Sep. 14, 1981

[51] Int. Cl.[3] ..... G09G 3/22

[52] U.S. Cl. ..... 340/786; 350/353; 350/354

[58] Field of Search ..... 340/786; 350/353, 354

[56] References Cited

U.S. PATENT DOCUMENTS

| | | | |
|---|---|---|---|
| 3,090,687 | 5/1963 | Berman | 350/354 |
| 3,219,993 | 11/1965 | Schwertz | 340/786 |
| 4,093,344 | 6/1978 | Damen et al. | 350/353 |
| 4,142,782 | 3/1979 | O'Brian | 350/354 |
| 4,169,661 | 10/1979 | Yamada et al. | 350/353 |

*Primary Examiner*—Marshall M. Curtis
*Attorney, Agent, or Firm*—Peter L. Berger

[57] ABSTRACT

Disclosed is an erasable display apparatus including a heat-sensitive medium 1 having a hysteresis effect relative to temperature change. This display apparatus comprises an endless broad-width heat-sensitive display medium 1, driving means 2 for rotating and transferring the heat-sensitive display medium 1, a first heating member 3 for thermally recording information to be displayed on the heat sensitive display medium 1, a plane transparent panel heater 4 disposed on the back of the display surface contiguously to the heat-sensitive display medium 1, lighting means 5 disposed on the back of the transparent heat-insulating member 4 to illuminate the display surface, a color filter 6 disposed in front of the display surface and cooling means 7 for erasing the information recorded on the heat-sensitive display medium 1 after display. By this display apparatus, a display can be accomplished at a high density and the displayed picture quality can be enhanced. This display apparatus can be used repeatedly at a high frequency.

7 Claims, 12 Drawing Figures

DISPLAY APPARATUS UTILIZING A THERMALLY COLOR REVERSIBLE DISPLAY MEDIUM WHICH HAS A HYSTERESIS EFFECT

TECHNICAL FIELD

The present invention relates to a thermal display apparatus for use as an automatic character printer or the like. More particularly, the present invention relates to an erasable thermal display apparatus using a thermal display medium which has a hysteresis effect relative to a temperature change.

BACKGROUND ART

In the technical field of an automatic character printer, an electronic guiding apparatus, an information retrieval apparatus or the like, an economical and small display apparatus capable of displaying the same amount of information as recorded on one recording sheet, or a display apparatus using a recording paper which can be used repeatedly, has widely been desired.

One example of the conventional display apparatus of this type is proposed in U.S. Pat. No. 3,219,993. According to this prior art technique, a thermally reversible medium is used as a display medium, and by switching the direction of an electric current passing through a Peltier junction mounted on the display medium, the display medium is heated to effect recording or is reversibly cooled to erase the displayed record. In this prior art technique, however, it is very difficult to accumulate such Peltier junctions playing an important role for the display at such a high density as 64 picture elements per square millimeter, and such high-density accumulation of Peltier junctions results in increase of the manufacturing cost of the display apparatus. Furthermore, in this conventional apparatus, each Peltier junction should electrically be connected through a metal having a good thermal conductivity, which causes problem of conduction of heat among adjacent Peltier junctions and also causes reduction of the recording quality.

Another conventional apparatus of this type is disclosed in Japanese Patent Publication Ser. No. 52-49948. In this conventional apparatus, a thermo-reversible display medium is used as in case of the above-mentioned conventional technique, and recording is effected by instantaneously heating thermal elements accumulated on the display medium and then, the display medium is rotated and transferred from the display surface to another position to effect cooling for erasing the record. In this conventional apparatus, the color change for recording is a change of yellow to yellowish orange or red to reddish violet, and therefore, the contrast between the two colors is not sufficient. Moreover, these colors are problematical from the standpoint of the human engineering, but this problem is not taken into consideration in the prior art technique at all. Furthermore, the hysteresis characteristic of the display medium involves a problem of the thermal inertia, but the problem is not at all taken into account. The problem of thermal inertia referred to herein is that when the frequency of the repeated use of the display medium is high, for example, about one minute, the color of the recorded area cannot be restored to the original color only by cooling the display medium and a residual image is left at the subsequent display operation. This problem also is involved in the first-mentioned prior art.

It is therefore a primary object of the present invention to provide a small and economical display apparatus in which high-density display can be accomplished on a thermal display medium which has a hysteresis effect between the temperature and color.

Another object of the present invention is to provide a display apparatus in which the quality of a picture pattern on the display surface can be improved by using novel lighting and color filter means.

Still another object of the present invention is to provide a display apparatus in which the displayed record can be erased promptly and uniformly when the display medium is repeatedly used.

DISCLOSURE OF THE INVENTION

In the present invention, recording of information on a display medium is performed by a thermal head comprising thermal elements accumulated and integrated at high density. As the display medium, there is used a heat-sensitive display medium in which the color is changed from yellow to yellowish orange at a relatively low temperature of 50° C. and the original color is restored at 26° C. This heat-sensitive display medium is rotated by driving means to confront to an observer as a display surface. The portion of the display medium that acts as the display surface is maintained at about 40° C. by a transparent heat-insulating member so as to keep the recorded information. For better recognition of the color change by the observer, lighting means and color filter means are disposed, whereby the contrast is enhanced and the color change is transformed to a green-to-black change. Erasing of the recorded information is accomplished by uniformly heating the entire display medium to effect the color change by a second heating member such as an infrared ray heater and cooling the display medium by cooling means. By this arrangement, uniform erasing is assuredly realized and the frequency of the repeated used can be elevated.

BEST MODE FOR CARRYING OUT THE INVENTION

The present invention will now be described in detail with reference to the accompanying drawings.

Figure 1:
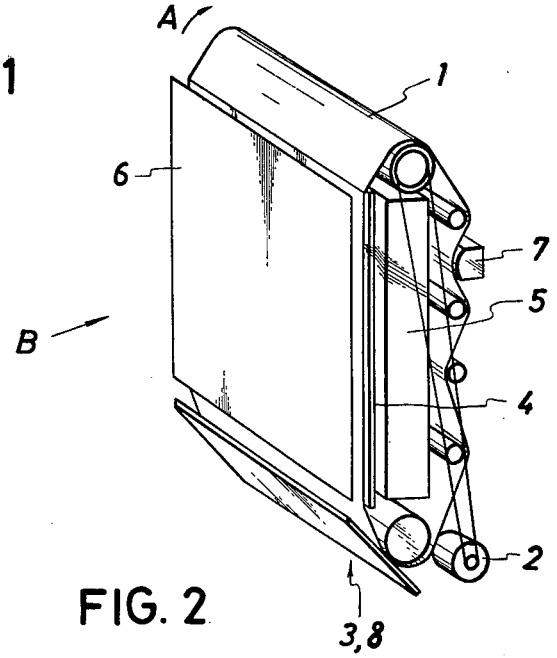
FIG. 1 is a schematic perspective view illustrating one embodiment of the display apparatus according to the present invention.

FIG. 1 is a schematic perspective view illustrating one embodiment of the display apparatus according to the present invention, in which reference numerals 1, 2, 3, 4, 5, 6 and 7 represent a heat-sensitive display medium, driving means, a first heating member, a transparent panel heater, lighting means, a color filter and cooling means, respectively.

The heat-sensitive display medium 1 consists of an endless broad-width belt-like display medium, which is formed by sandwiching a reversible temperature-indicating material having such a property that the color is changed from yellow to yellowish orange when heated at a temperature higher than 50° C. and the yellowish orange color is restored to the original yellow color when cooled below 26° C., with polyester films. The dimension of the heat-sensitive display medium 1 are arranged so that the width is, for example, about 280 mm and the length is, for example, about 1,000 mm. The heat-sensitive display medium 1 is rotated in a direction indicated by an arrow A by the driving means 2.

The driving means 2 comprises an AC synchronous motor which is actuated and de-energized by an electronic on-off control to rotate the heat-sensitive display medium 1 along a predetermined distance over a period of a predetermined time or to stop the heat-sensitive display medium 1.

Information to be displayed on heat-sensitive display medium 1 is thermally recorded on the heat-sensitive display medium 1 in the line sequential manner synchronously with the driving means 2 by a thermal head consisting of many aligned heating elements arranged on the lower end in the direction of the display surface indicated by an arrow B. The thermal head 8 has a resolution of 8 dots per millimeter, and 1792 heating elements are accumulated in a line and the entire length of the thermal head 8 is 224 mm. The resolution of the thermal head in the subsidiary scanning direction is 8 lines per millimeter. Since the A-4 size is of 210 mm×297 mm, about 4 Mbits of picture elements can be displayed.

On the back of the portion of the heat-sensitive display medium 1 that corresponds to the display surface, the transparent panel heater 4 is disposed contiguously to the heat-sensitive display medium 1. The recorded information can be stored semi-permanently by maintaining the heat-sensitive display medium 1 at 40° C. by the transparent panel heater 4. As the transparent panel heater 4, there is used, for example, a member fabricated by vacuum-depositing transparent resistant film of $SnO_2$ or the like on a transparent reinforced glass substrate. In order to maintain a uniform temperature throughout the display surface, the transparent heat-insulating member 4 is controlled at a certain temperature by a temperature control circuit not shown in the drawings.

Simultaneously when the heat-sensitive display medium 1 is maintained at the predetermined temperature by the transparent panel heater 4, the entire display surface is uniformly irradiated with rays by the lighting means 5 disposed on the back of the transparent panel heater 4. The rays which have been transmitted through the heat-sensitive display medium 1 pass through the bluish green filter 6 disposed in front of the heat-sensitive display medium 1. By the optical filtering action of the color filter 6, the color of the non-recorded area is changed from yellow to green and the color of the recorded area is changed from yellowish orange to black.

After display has thus been effected, the picture surface which becomes unnecessary is rotated by the driving means 2 simultaneously when information is recorded and displayed on a new picture surface, and/the rotated picture surface is thus transferred to the cooling means 7. The temperature of the cooling means 7 is controlled to 20° to 25° C. and the cooling means 7 is brought into contact with the heat-sensitive display medium 1 to cool the heat-sensitive medium 1 below 26° C., whereby the original color is restored in this portion.

For better illustration of the present invention, the respective consituent members of the display apparatus will now be described in detail.

Figure 2:
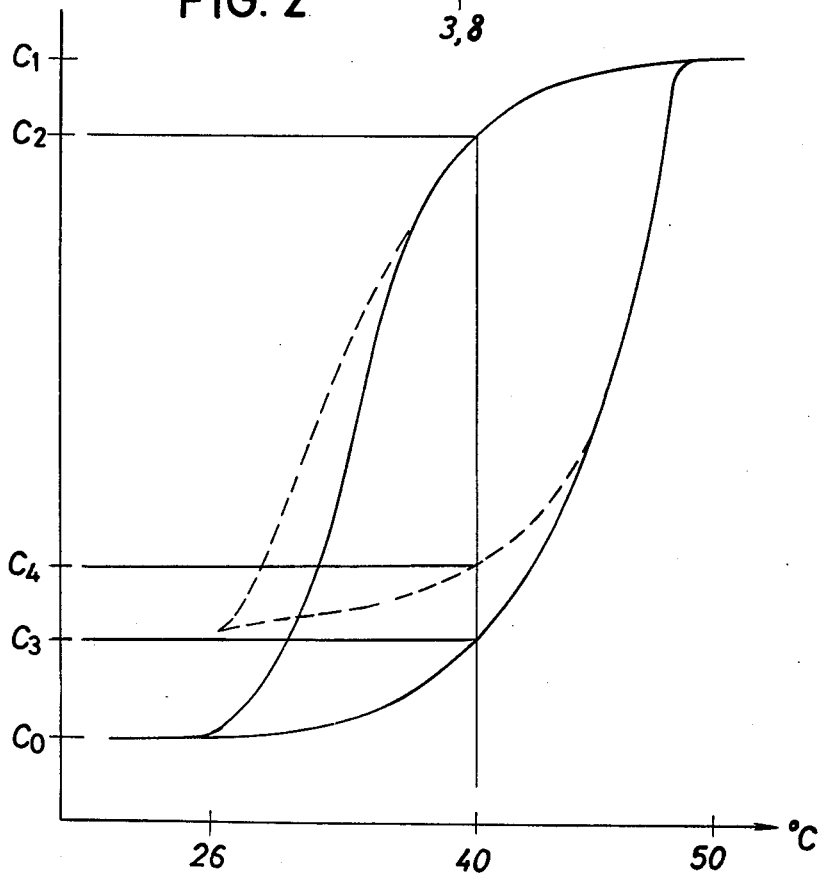
FIG. 2 is a graph showing the hysteresis curve of a display medium.

FIG. 2 is a graph showing the temperature-color hysteresis curve of the heat-sensitive display medium 1. The temperature is plotted on the abscissa and the color on the ordinate. When the heat-sensitive display medium 1 is heated at a temperature higher than 50° C. by the thermal head 8, the color is changed from yellow $C_0$ to yellowish orange $C_1$. On the contrary, when the temperature of the heat-sensitive display medium 1 is gradually lowered, the color begins to change at the point when the temperature is lowered below 40° C. and the original yellow color $C_0$ is restored at 26° C. On the heat-sensitive display medium 1, there exists the portion heated at a temperature higher than 50° C. by the thermal head 8 and the non-heated portion. Accordingly, if the heat-sensitive display medium 1 is maintained at, for example, 40° C. by the transparent panel heater 4, the color of the portion heated at a temperature higher than 50° C. is changed to $C_2$ and the color of the non-heated portion is changed to $C_3$. In short, there can simultaneously be produced two different colors $C_2$ and $C_3$ on the heat-sensitive display medium.

Figure 3:
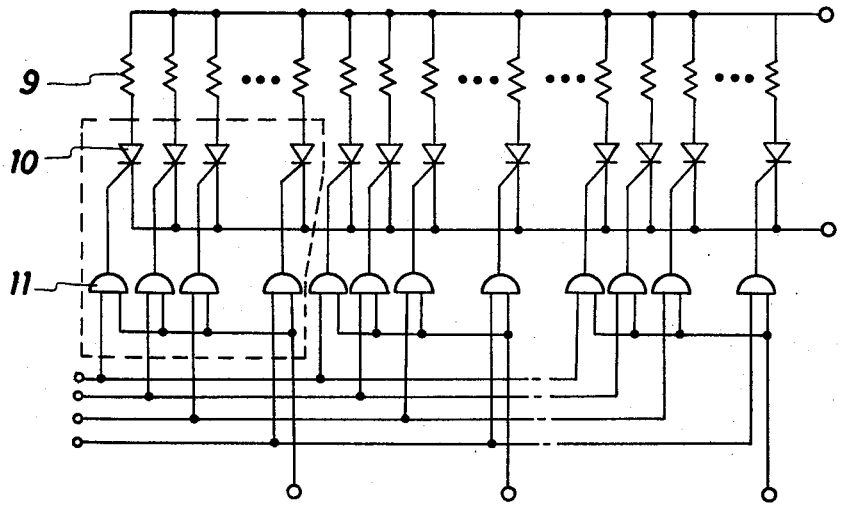
FIG. 3 is a block diagram showing a thermal head.
Figure 4:
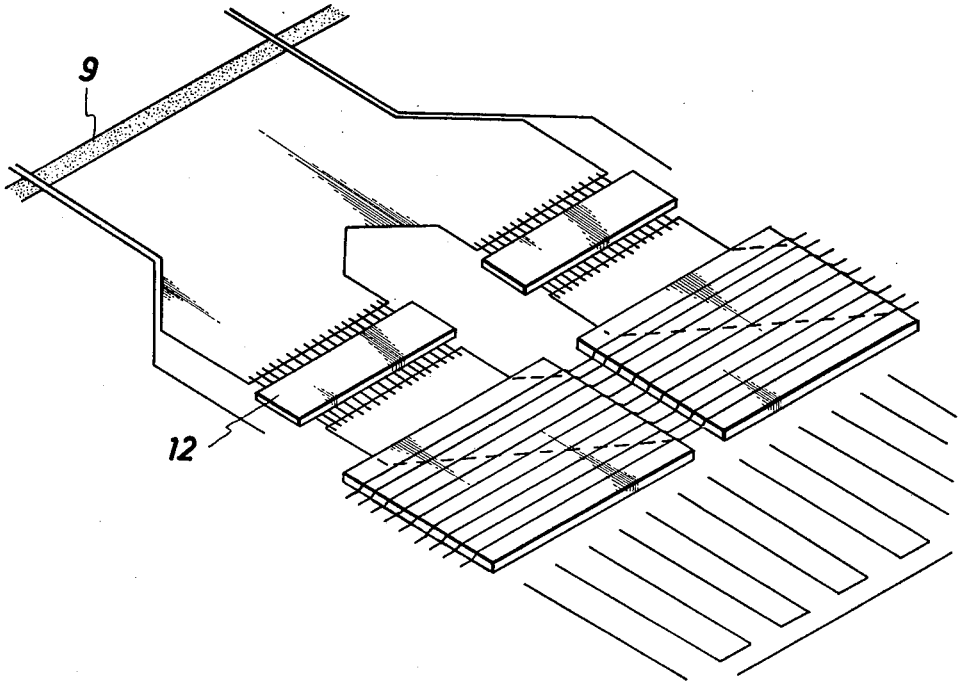
FIG. 4 is a partial schematic view illustrating the state where the thermal head shown in FIG. 3 is actually mounted.

FIG. 3 is a block diagram showing the thermal head 8 and FIG. 4 is a partial schematic view showing the state where the thermal head 8 is actually mounted. The thermal head 8 comprises 1792 of aligned heating elements 9, which are simultaneously driven on receipt of information to be recorded. The thermal head 8 includes a beam lead IC 12 fabricated by integrating a thyrister switch 10 having a storing capacity with a matrix input gate circuit 11, which is disposed to reduce the number of take-out lines in the thermal head 8. The pitch of the heating elements 9 is 125 μm, and the accumulation density of the heating elements 9 is very high. When this thermal head 8 is used, a subsidiary scanning density of 8 lines per millimeter can be obtained, and information of an A-4 size of 210 mm×297 mm can be recorded within 10 seconds.

Figure 6:
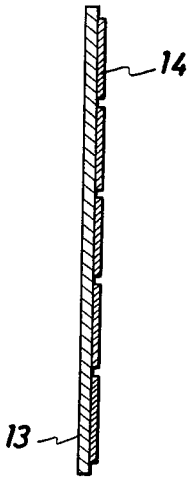
FIG. 6 is a side view of the transparent heat-insulating member shown in FIG. 5.
Figure 5:
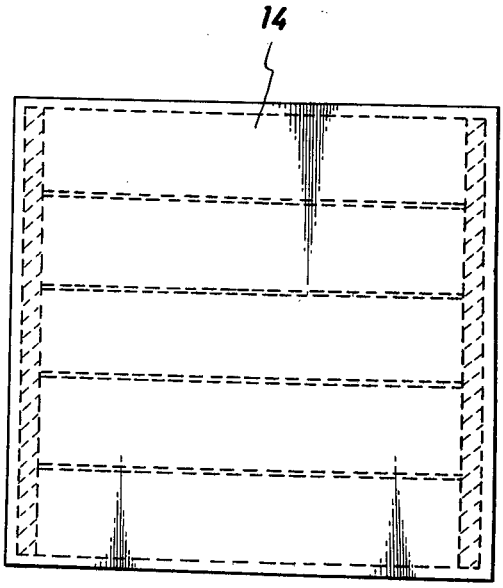
FIG. 5 is a plan view illustrating a transparent heat-insulating member.

FIG. 5 is a plan view illustrating a plane transparent panel heater 4, and FIG. 6 is a side view of the transparent panel heater 4 shown in FIG. 5. This transparent panel heater 4 is fabricated by vacuum-deposited transparent resistant film 14 of $SnO_2$ or the like on one surface of a transparent, heat-resistant glass substrate 13 and forming electrodes on both the ends. Each transparent resistant film 14 is divided into five parts in the vertical direction so as to uniformalize the temperature distribution throughout the transparent panel heater 4. Furthermore, in order to impart predetermined values of the quantity of the generated heat to the respective transparent films 14 and produce a predetermined distribution of the quantity of the generated heat, there exists portions where such transparent resistant film 14 is not formed. The transparent panel heater 4 is controlled at a certain temperature of 40° C. by a temperature-controlling circuit including a temperature-detecting thermocouple not shown in the drawings. There may be adopted a method in which the temperatures of the respective transparent resistant films 14 are independently controlled.

Figure 7:
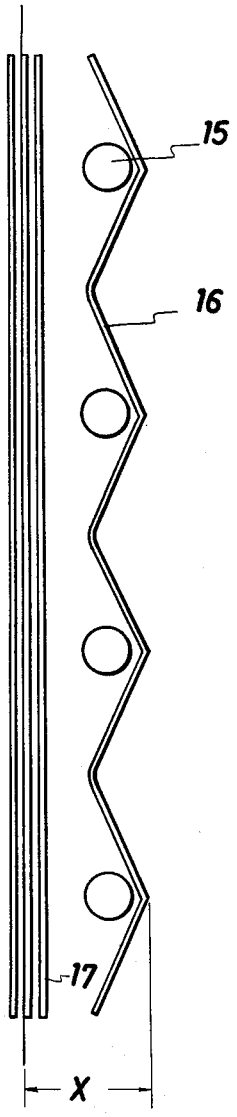
FIG. 7 is a detailed side view showing lighting means.

FIG. 7 is a detailed side view illustrating lighting means 5, which ordinarily comprises a rod-like light source of a fluorescent lamp and a bent reflecting plate 16 disposed on the back of the light source 15, whereby a uniform image-wise illumination is formed on a diffusing plate 17 disposed in front of the reflecting plate 16. Incidentally, in the present embodiment, the depth X of the illuminating means 5 is about 35 mm, and the illumination deviation is within ±5%.

Figure 8:
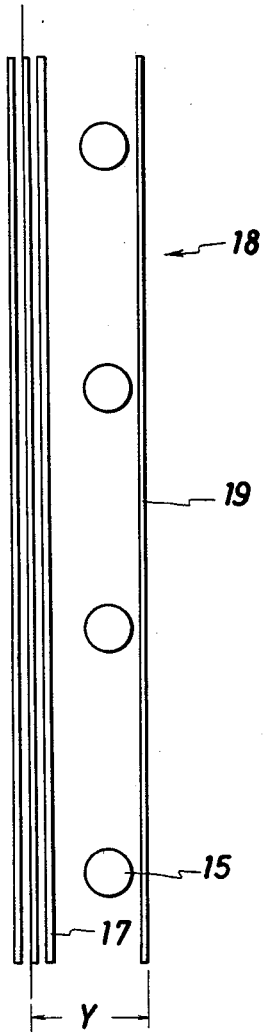
FIG. 8 is a detailed side view showing another lighting means.

FIG. 8 illustrates another lighting means 18, which comprises a flat reflecting plate 19. In this embodiment, the depth Y of the lighting means 18 is about 45 mm and the illumination deviation is within ±5%.

Figure 9:
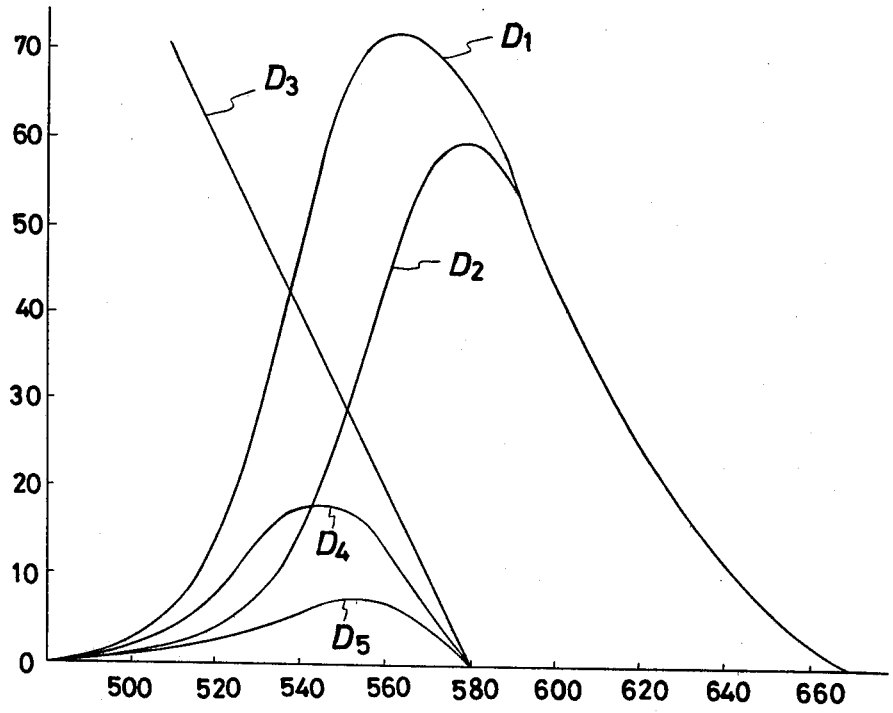
FIG. 9 is a graph illustrating the optical filtering effect of a color filter.

FIG. 9 is a graph illustrating the optical filtering effect of the color filter 6, in which the wavelength is plotted on the abscissa and the product of the percent transmission and the luminous efficiency of a man is plotted on the ordinate. In this graph, curve $D_1$ shows the percent transmission wavelength characteristic of the non-color-changed portion of the heat-sensitive display medium 1. By the percent transmission referred to herein is meant an idea inclusive of the sight sense characteristic of a man. Curve $D_2$ shows the percent transmission-wavelength characteristic of the color-changed portion of the heat-sensitive display medium 1, and curve $D_3$ shows the percent transmission-wavelength characteristic of the filter 6. Curve $D_4$ shows the product of curve $D_1$ and $D_3$, that is, the characteristic when a man sees the heat-sensitive medium 1, in which no color change occurs, through the color filter 6, and curve $D_5$ shows the product of curves $D_2$ and $D_3$, that is, the characteristic when a man sees the color-changed heat sensitive display medium 1 through the color filter 6.

From this graph, it will readily be understood that two important effects are attained by using the color filter 6. The first effect is an enhanced color contrast on the display surface. This will readily be understood from the fact that the contrast between the curves $D_1$ and $D_2$ which is observed when the color filter 6 is not used is much lower than the contrast between the curves $D_4$ and $D_5$ which is observed when the color filter 6 is used. The second effect is a color-converting function of the color filter 6. More specifically, when the color filter 6 of the green system is used in the present embodiment, the color change between colors of the same series, that is, the color change between yellow and yellowish orange, can be converted to a density change between colors of the green system which can easily be recognized from the standpoint of human engineering. Of course, if the color filter 6 is used, the quantity of light is inevitably reduced. However, in order to compensate this reduction of the quantity of light, the above-mentioned lighting means 5 is disposed in the present invention. By illumination with rays of the transmitted type by the lighting means from the back of the display surface constructed by the color filter 6, the heat-sensitive medium 6 and the transparent panel heater 4, the display can be definitely be seen without any dazzle uniformly throughout the display surface. Furthermore, by disposing the bent reflecting plate 16 for the lighting means 5, the depth can be shortened, with the result that the size of the display can be diminished and the power consumption can be reduced.

Figure 10:
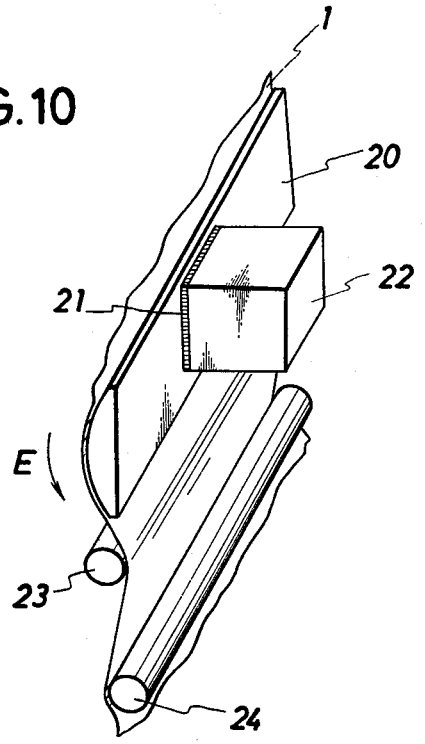
FIG. 10 is a detailed perspective view illustrating cooling means.

FIG. 10 is a detailed perspective view illustrating cooling means 7, in which reference numerals 20, 21 22 and 23 and 24 represent a cooling metal plate, an electronic cooling element, a heat discharger and water-sucking rollers, respectively.

The cooling metal plate 20 formed of, for example, aluminum is brought into contact with the heat-sensitive display medium 1 to cool the medium 1 and this cooling metal plate 20 is also brought into contact with the cooling surface of the electronic cooling element 21 utilizing the Peltier effect, and the heat-generating surface of the electronic cooling element 21 is brought into contact with the heat dischanger 22. Thermal compound materials are used for these contact portions to improve the thermal conductivity, and the electronic cooling element 21 is sandwiched between the cooling metal plate 20 and the heat discharger 22. A heat-insulating material such as a rubber, which is not shown in the drawings, is disposed for the cooling metal plate 20 on the surface opposite to the surface on which the heat-sensitive display medium 1 is located.

Each of the water-sucking rollers 23 and 24 is formed of, for example, a porous polymeric material, and they are disposed to remove water drops formed on the heat-sensitive display medium 1 and cooling metal plate 20. More specifically, under bad atmospheric conditions, for example, a temperature of 35° C. and a relative humidity of 85%, water drops are formed on the surface of the heat-sensitive display medium 1 and cooling metal plate 20 cooled to 20° to 25° C., and the water-sucking rollers 23 and 24 are disposed to absorb these water drops before the heat-sensitive display medium 1 is rotated in a direction indicated by an arrow E.

The electronic cooling element 21 is controlled by a temperature-controlling circuit not shown in the drawings, so that the average temperature of the cooling metal plate 20 is 20° to 25° C.

Figure 11:
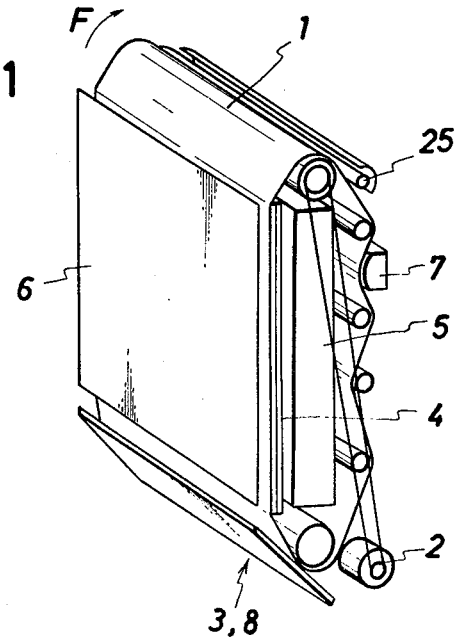
FIG. 11 is a schematic perspective view illustrating another embodiment of the display apparatus according to the present invention.

FIG. 11 is a schematic perspective view illustrating another embodiment of the display apparatus to the present invention, in which the display surface is renewed at such a high frequency of several seconds to scores of seconds.

As pointed out hereinbefore, the heat-sensitive medium involves a problem of thermal inertia. For example, if the display medium is used repeatedly at a high frequency, as indicated by a broken line in FIG. 2, only by lowering the temperature of the heat-sensitive display medium 1, the mingling state of colors $C_3$ and $C_4$ is brought about and complete restoration to color $C_0$ becomes impossible. This problem of the thermal inertia resulting in occurence of such practical trouble that the residual image on the display surface can be visually recognized and the picture quality is drastically degraded.

In the embodiment shown in FIG. 11, a second heating member 25 is disposed in front of the cooling means 7 to uniformly discolor the heat-sensitive display medium 1 by heating before the heat-sensitive display medium 1 is cooled, whereby even if the heat-sensitive display medium 1 is used repeatedly at a relative high frequency, thereby uniform erasing becomes possible and a residual image of the preceding display is not left at all, and hence, the picture quality can be enhanced.

Figure 12:
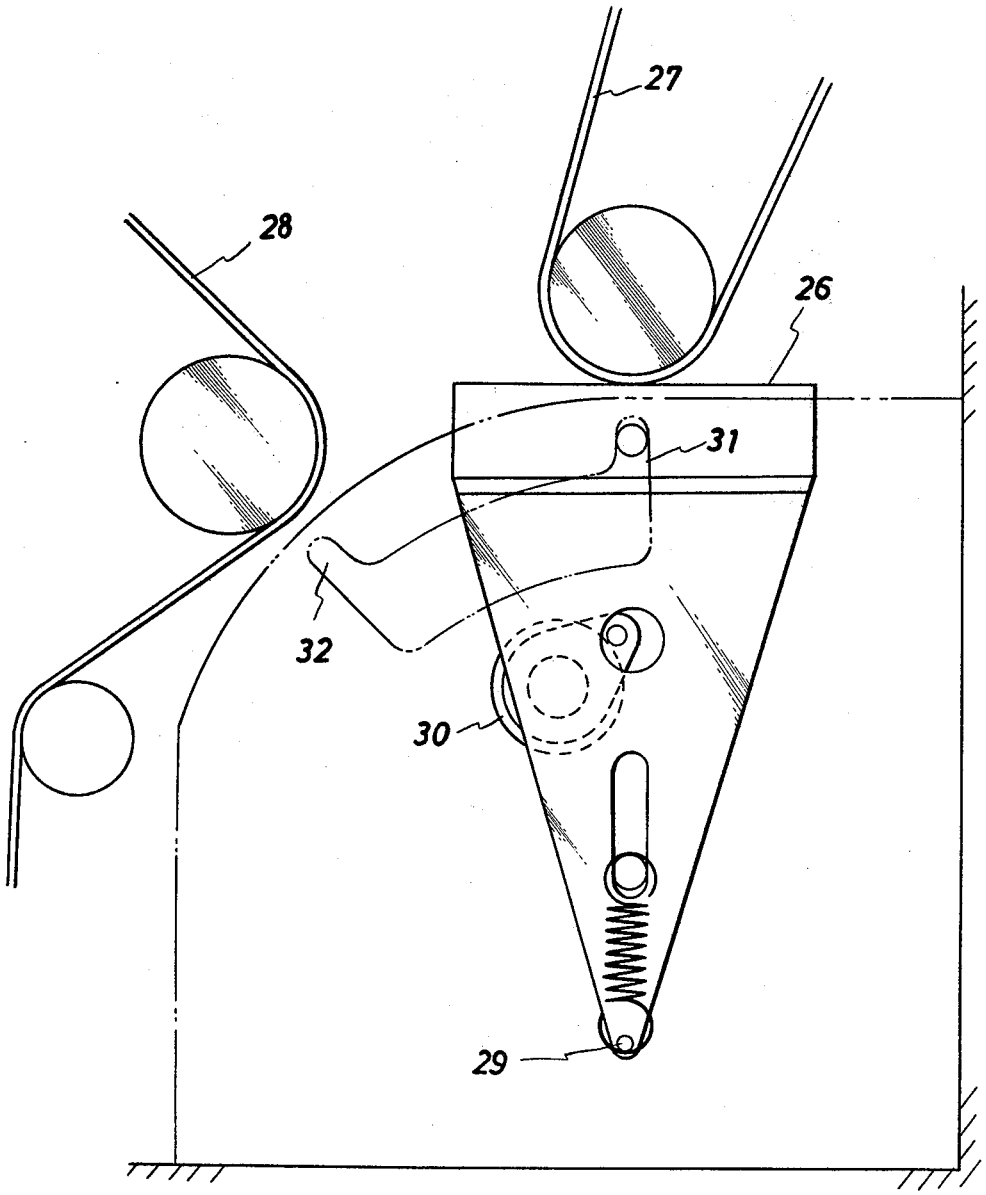
FIG. 12 is a partial schematic view illustrating still another embodiment of the present invention.

FIG. 12 is a partial schematic view illustrating still another embodiment of the display apparatus according to the present invention, in which a single thermal head 26 can be switched to a heat-sensitive display medium 27 or a heat-sensitive recording paper 28. More specifically, the thermal head 26 is arranged so that it is rotated with a hook pin 29 being as the center by a motor 30, and the thermal head 26 can be fixed at a positioning groove 31 or 32. If the thermal head 26 is fixed at the positioning groove 31, the thermal head 26 heats the heat-sensitive display medium 27 to effect display, and if the thermal head 26 is fixed at the positioning groove 32, the thermal head 26 heats the heat-sensitive recording paper 28 to effect recording. The heat-sensitive recording paper 28 may be in the form of a roll or a sheet cut into a predetermined length. Manual switching means may be used instead of the motor 30. In this embodiment, thermal display and recording can be accomplished by the single thermal head 26.

INDUSTRIAL APPLICABILITY

As will apparent from the foregoing description, according to the display apparatus of the present invention, high-density display can be accomplished on a heat-sensitive display medium having a hysteresis effect between the temperature and color, and the quality of the displayed picture formed on the display surface can be enhanced. Furthermore, since the displayed record can uniformly be erased, the display apparatus of the present invention can exert significant effects in the field of an automatic character printer or the like.

What is claimed is:

1. A display apparatus comprising a heat-sensitive medium of an endless, broad-width belt-like shape having a hysteresis effect between the temperature and color, driving means for rotating and transferring said heat-sensitive display medium, a first heating member comrpising a plurality of heating elements aligned in the lateral direction of the heat-sensitive display medium, a plane transparent panel heater located on the back of the display surface contiguously to the heat-sensitive display medium, lighting means disposed on the back of the transparent heat-insulating member to illuminate the display surface, a color filter disposed in front of the display surface, and cooling means for cooling the heat-sensitive display medium after display, and a second heating member disposed in the passage of the heat-sensitive display medium between the transparent panel heater and the cooling means, the entire heat-sensitive medium being uniformly discolored by said second heating member to erase said information recorded on the heat-sensitive display medium.

2. A display apparatus as set forth in claim 1, wherein the transparent panel heater is divided in at least three parts, further comprising an electrode structure to independently control said parts of said transparent panel heater.

3. A display apparatus as set forth in claim 1, wherein the transparent panel heater comprises a divided electrode structure wherein a predetermined distribution of the quantity of the generated heat is produced and a uniform temperature distribution is attained throughout the display surface.

4. A display apparatus as set forth in claim 1, wherein the lighting means comprises a plurality of rodlike light sources, a diffusing plate disposed in front of said rodlike light sources and a flat reflecting plate disposed on the back of the rod-like light sources.

5. A display apparatus as set forth in claim 1, wherein the lighting means comprises a plurality of rod-like light sources, a diffusing plate disposed in front of the rodlike light sources and a reflecting plate disposed on the back of the rod-like light sources, said reflecting plate being bent to conform to the arrangement of the rodlike sources.

6. A display apparatus as set forth in claim 1, wherein the hysteresis effect of said heat-sensitive display medium relative to temperature change is such that the heat-sensitive display medium has first and second different color states at a certain temperature, in the first color state a lower percent transmission is changed to a higher percent transmission with a wavelength $\lambda_1$ serving as the boundary when the wavelength exceeds $\lambda_1$ and in the second color state the lower percent transmission is changed to the higher percent transmission with a wavelength $\lambda_2$ larger than the wavelength $\lambda_1$ serving as the boundary if the wavelength exceeds the $\lambda_2$ and the color filter has a lower percent transmission characteristic at a wavelength larger than the wavelength $\lambda_2$ and also has a higher percent transmission characteristic at least in a wavelength region of from the wavelength $\lambda_1$ to the wavelength $\lambda_2$.

7. A display apparatus as set forth in claim 1, wherein the cooling means comprises a cooling metal plate, a heat discharger and an electric cooling element utilizing a Peltier effect, said electric cooling element being sandwiched between the cooling metal plate and the heat discharger, and water sucking rollers are disposed to absorb water drops formed on the heat-sensitive display medium after the heat-sensitive display medium has passed through said cooling means.

* * * * *